US006408673B1

(12) United States Patent
Körner et al.

(10) Patent No.: US 6,408,673 B1
(45) Date of Patent: Jun. 25, 2002

(54) ADJUSTING PLATE FOR A PRESS

(75) Inventors: Ekkehard Körner, Göppingen; Richard Knödler, Schwäbisch Gmünd, both of (DE)

(73) Assignee: Schuler Pressen GmbH & Co. KG, Göppingen (DE)

( * ) Notice: Subject to any disclaimer, the term of this patent is extended or adjusted under 35 U.S.C. 154(b) by 0 days.

(21) Appl. No.: 09/654,896

(22) Filed: Sep. 5, 2000

(30) Foreign Application Priority Data

Sep. 3, 1999 (DE) ..... 199 41 925

(51) Int. Cl.[7] ..... B21J 13/00
(52) U.S. Cl. ..... 72/446; 100/257
(58) Field of Search ..... 72/446, 448, 404; 100/257

(56) References Cited

U.S. PATENT DOCUMENTS 2,979,975 A 4/1961 Schloz et al.
3,030,878 A * 4/1962 Holzer ..... 72/446
3,889,515 A 6/1975 Grombka
4,307,600 A * 12/1981 Flamme ..... 72/446
4,676,090 A * 6/1987 Nishimura ..... 72/446
4,791,803 A * 12/1988 Broquet ..... 72/446
5,105,649 A * 4/1992 Hite ..... 72/446
5,884,520 A * 3/1999 Bakermans ..... 72/446

* cited by examiner

*Primary Examiner*—Daniel C. Crane
(74) *Attorney, Agent, or Firm*—Crowell & Moring LLP

(57) ABSTRACT

An adjusting plate (20) for a transfer press (1) has several individually adjustable tool mounting sites (bearing devices). An individually adjustable adjusting device (25) is assigned to each mounting site (15*a*, 16*a*, 17*a*, 18*a*). Sensor devices (36) provide an acknowledgment concerning the set adjusting position. The adjusting devices (25) are also connected with individual blocking devices (51). The adjustment and blocking take place by way of corresponding hydraulic drives (35, 52) or can take place manually.

10 Claims, 4 Drawing Sheets

ADJUSTING PLATE FOR A PRESS

The invention relates to an adjusting plate for a transfer press, particularly a transfer press for massive forming.

In massive forming, for example, by means of forging pressing, the workpiece is formed by means of a tool which is divided into an upper and a lower tool part. While, as a rule, one of the tool parts is stationary and is arranged for this purpose on the bedplate of a press, the other tool part is moved relative thereto and is connected with the slide of the press for this purpose. By means of its movement, the slide determines the relative movement between the tool parts. For achieving a desired machining result, it is, as a rule, required that the desired lower dead center of the moved tool part, that is, the point of the maximal approach of both tool parts, is precisely maintained during the operation of the press.

Adjusting devices have been developed for this purpose by means of which the position of at least one of the tool parts can be adjusted. For example, from German Patent Document DE-OS 2530400, an adjusting device for a forging press is known which is called a wedge device. The wedge device comprises a stationarily arranged wedge on whose inclined plane a second wedge rests which points in the opposite direction. This wedge can be longitudinally displaced by an electric motor by way of a spindle gearing. A hydraulic device is used for a blocking and releasing when the wedge device is adjusted.

This wedge device provides an adjustable positioning of the fixed molds or forging dies in the press. The wedge device is adjustable for lifting and lowering the fixed molds so that they are arranged to fit the movable tool parts or tools carried by the slide.

In contrast from U.S. Pat. No. 2,979,975, an adjusting device is known which is integrated in the press slide. The adjusting device is used for adjusting linking points of a toggle lever drive, which are provided on the slide, with respect to the slide body. For this purpose, wedge drives are assigned to the linking points, which wedge drives comprise one wedge respectively which can be adjusted transversely to the working direction of the slide. The wedge is supported on a pressure surface pertaining to the slide as well as on a pressure surface pertaining to the linking point and can be adjusted by way of a threaded spindle. By way of a gearing, this threaded spindle is driven by a motor. A nut, which is adjusted by a threaded spindle provided on the slide, is used for indicating the adjustment. The threaded spindle is connected with the spindle drive of the wedge adjusting device. In addition, limit switches are provided in order to stop the motor of the adjusting device when the end of the adjusting range is reached.

During the pressing by means of several tool stages, the adjustment of the slide or of the bedplate affects all tool stages to the same extent. An optimal mutual coordination of the stages is therefore difficult to achieve.

Based on the above, it is an object of the invention to provide a remedy and permit an individual adjusting of the individual stages.

The module plate according to the invention has a basic body on which several bearing devices are provided. These are used for adjusting one tool part respectively which is indirectly or directly supported on the bearing device. The bearing devices are preferably arranged in a row side-by-side and permit the individual adjustment of each connected tool part. For example, by means of this module plate, the dies are individually adjustable which are part of several bottom tools or of one bottom tool having several workpiece positions. The adjusting plate is therefore preferably used for the tool adjustment in transfer presses. The adjusting plate can be used on the slide or the bedplate, depending on whether the top tool or the bottom tool are divided into individual tools each representing one tool stage. By means of the adjusting plate, the tool parts can be adjusted not only individually but also identically by the same amount. Additional adjusting devices, for example, for the slide adjustment or bedplate adjustment are not required and can be eliminated. The multiple procuring for the slide adjustment and the wedge adjustment in each tool is not necessary.

The adjusting plate can be screwed to the slide and can remain in the press during the tool change. It does not have to be exchanged during the tool change. However, it can be removed as required in order to create, for example, a higher installation space for a one-stage tool.

A driving device is assigned to each adjusting device, by means of which driving device the adjusting device can be individually operated. The driving device permits the operation of the adjusting device without manual access to the adjusting device and the working space of the press.

The module plate is to be housed between the slide and the tool or between the bedplate and the tool in the working space of the press. In this case, it is endeavored to limit the working space of the press as little as possible.

The module plate is provided with connecting devices for the detachable fastening on the press slide or the bedplate of the press. It can therefore be used for the subsequent retrofitting of presses.

A wedge gearing is preferably used as the adjusting device, in the case of which wedge gearing, the wedge can be moved transversely to the working direction of the press. A corresponding surface of the wedge, which is directed transversely to the working direction, comes to rest on a pressure surface of the module plate. A pressure surface of the wedge, which is at an acute angle thereto and thus extends in a slanted manner to the working direction of the slide, is used as a bearing surface for an adjustable tool part or an intermediate piece.

The module plate has holding or fastening devices for the fixed bearing and holding of tool parts which are not adjustable and which can be used as a guide for adjustable tool parts. In this case, preferably all bearing devices have such non-adjustable fastening devices. It thus becomes possible to fasten a tool with a non-adjustable guide part on the module plate, in which case the guide part will then guide the adjustable tool part. This division of the tasks of guiding and adjusting (the adjustment is carried out by the module plate; the guiding is carried out by the tool.) advantageously creates a module plate which can be used in a versatile manner and is suitable for different tools.

The adjusting drives of the module plate are preferably hydraulic drives or, as an alternative, electric drives. In addition, a sensor arrangement is preferably provided which detects not only end positions of the adjusting range but also detects and indicates intermediate positions. Thus, it becomes possible to carry out the tool adjustment in a remote-controlled manner, for example, by way of a central control device or by way of a press control unit.

In addition, the adjusting device is preferably coupled with a locking device in order to maintain adjusted positions during the operation of the press. The locking device preferably acts as a clamping device at a point of a gearing connection between the adjusting drive and the adjusting device upon a gearing element.

Additional details of advantageous embodiments of the invention are indicated in the drawing or the description as well as in the subclaims.

The drawing illustrates an embodiment of the invention.

Figure 1:
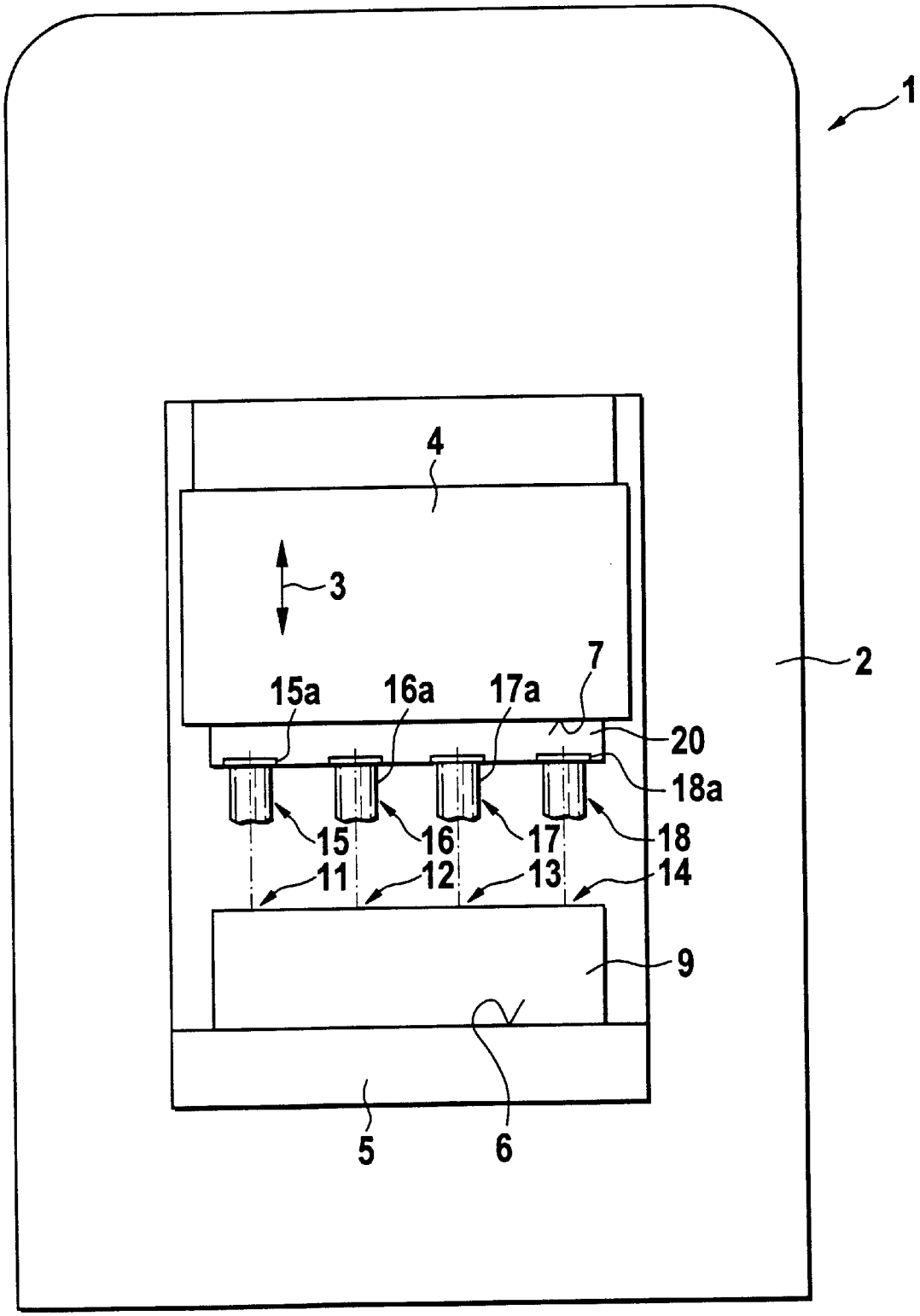
FIG. 1 is a schematic overall view of a transfer press.

FIG. 1 illustrates a transfer press 1 which has slides 4 which can be moved up and down in a press frame 2 in the direction of the arrow 3 by way of a drive which is not shown in detail. Below the slide 4, a bedplate 5 is constructed at the press frame 2, the mounting surface 6 of the bedplate 5 being essentially parallel to a mounting surface 7 of the slide 4.

A bottom tool 9 is arranged on the bedplate 6 and has several forging dies or workpiece receiving positions 11, 12, 13, 14 which are arranged in a row. A workpiece travels successively through these workpiece receiving positions 11 to 14. For the workpiece transport, a transfer system is provided which is not illustrated in detail and moves the workpieces in a timed manner from one tool stage to the next.

One die 15, 16, 17,18 respectively, which serves as a top tool, is assigned to the workpiece receiving positions 11 to 14, which die 15, 16, 17, 18, as indicated in each case by a dash-dotted line, is aligned with the respective workpiece receiving position 11 to 14. At the tool receiving positions 15*a*, 16*a*, 17*a*, 18*a*, the dies 15 to 18 are carried by an adjusting plate 20 which is detachably connected with the tool mounting surface 7 of the slide 4. It is used for the individual die adjustment.

Figure 2:
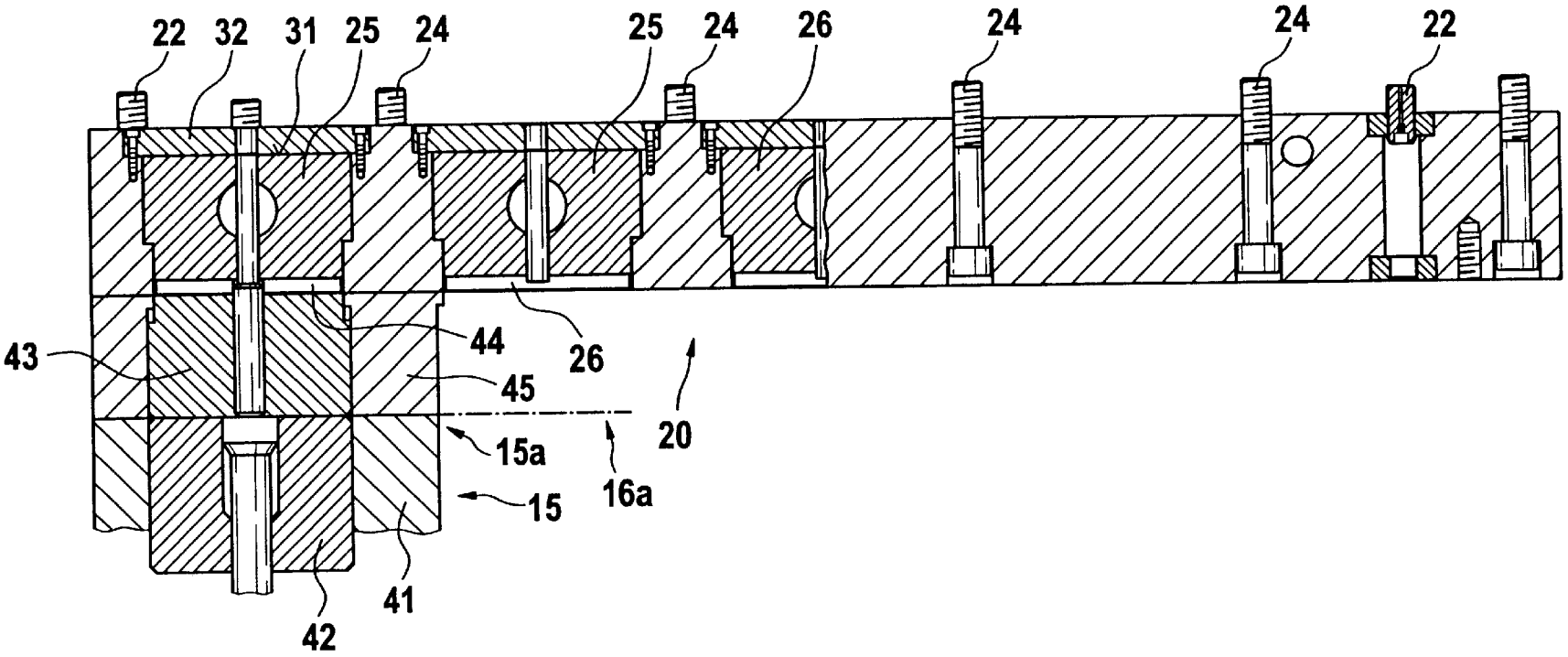
FIG. 2 is a schematic longitudinal sectional view of an adjusting plate which is fastened to the slide of the transfer presses according to FIG. 1.
Figure 3:
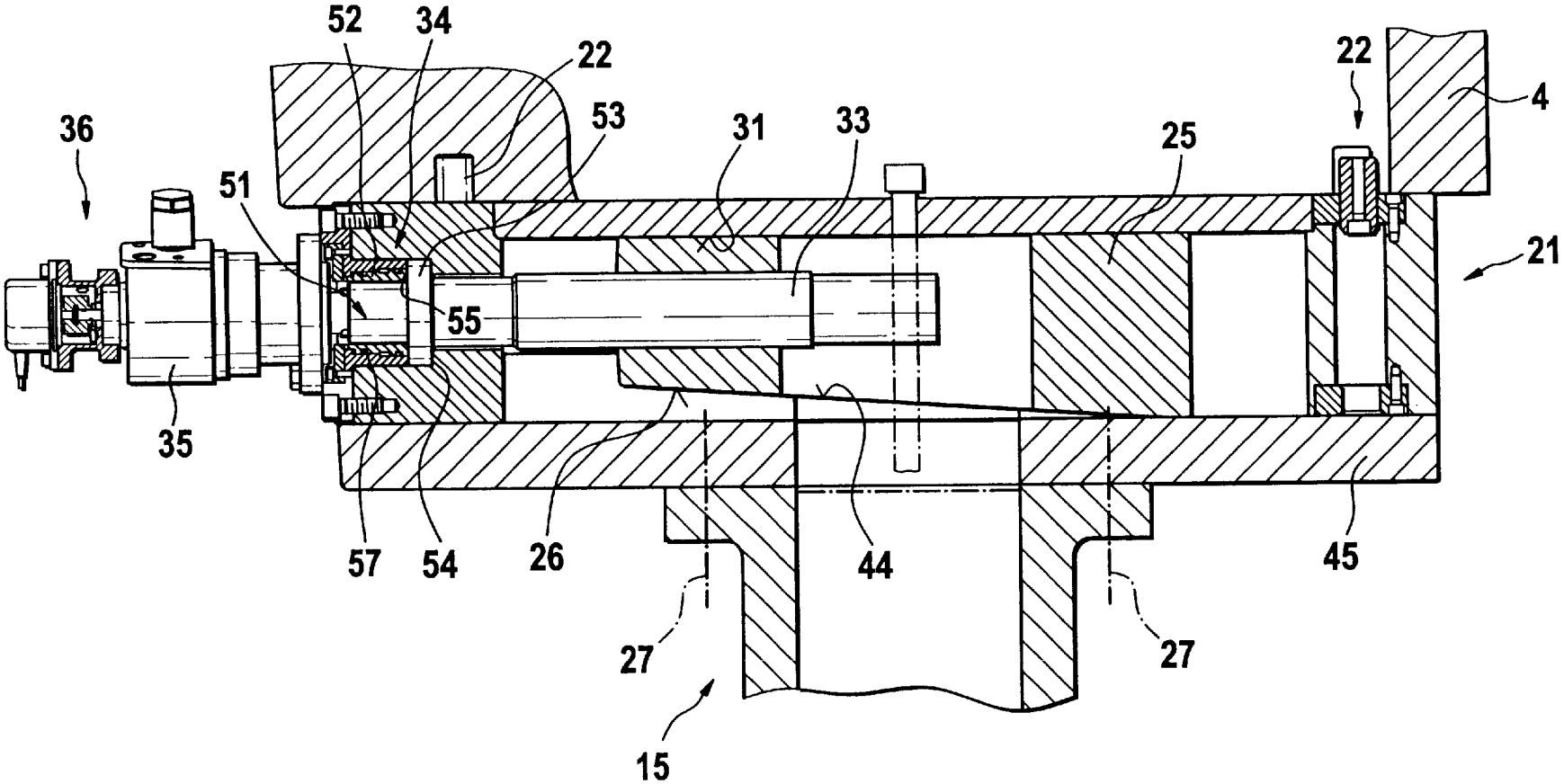
FIG. 3 is a cross-sectional view of the adjusting plate according to FIG. 2.

The adjusting plate 20 is illustrated in greater detail in FIGS. 2 and 3. It has a multipart basic body 21 which is aligned by way alignment pins 22 on the slide 4 or its tool mounting surface 7. Fastening bolts 24 are used for fastening the adjusting plate 20 on the slide 4.

The adjusting plate 20 has one wedge 25 respectively for each die 15, 16, 17, 18. This wedge 25 is used as an adjusting device and has an inclined surface 26. The inclined surface 26 is used as an adjusting or wedge surface. Fastening devices 27, which in FIG. 3 are schematically outlined by means of dash-dotted lines, are assigned to each wedge 25, which fastening devices 27 are used for fastening the tool on the adjusting plate 20 at the tool receiving positions 15*a* to 18*a*. The fastening device 27 consists, for example, of threaded bolts.

The wedge 25 has a contact surface 31 aligned transversely to the working direction 3 of the slide 4, which contact surface 31 comes to rest on a pressure plate 32 arranged in the basic body 21. On its other side, the pressure plate is supported on the slide 4 and is otherwise screwed to the basic body 21.

Figure 4:
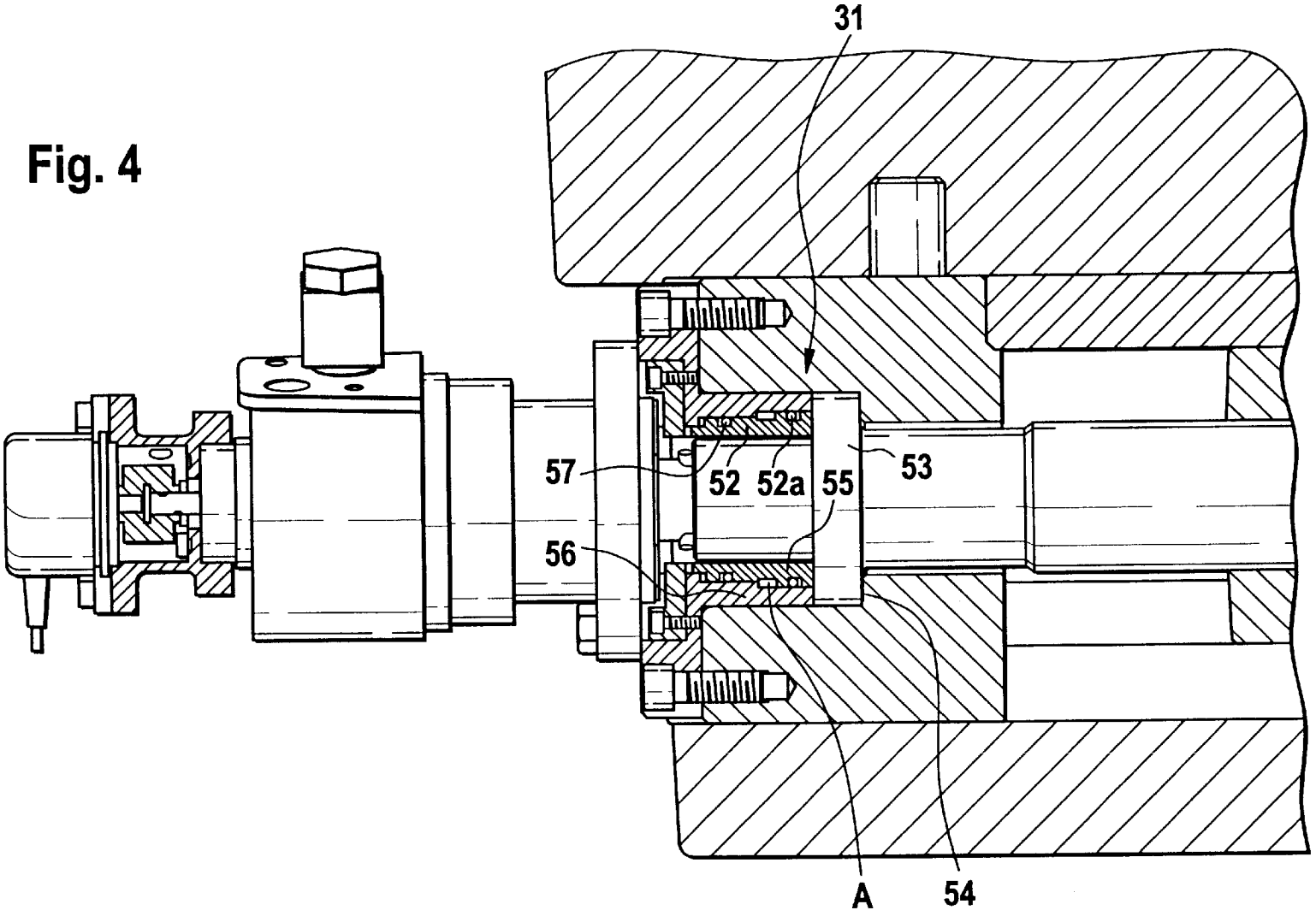
FIG. 4 is a cutout-type cross-sectional view at a different scale of the adjusting plate according to FIG. 3.

For adjusting the wedge 25, a threaded spindle 33 is provided which extends parallel to the pressure plate 32 and is held and rotatably disposed in a thrust bearing 34 on the end side. The thrust bearing 34, which is visible particularly in FIG. 4, is arranged in the basic body 21 and prevents an axial displacement of the threaded spindle 33 which, by means of its thread-bearing end, engages in a corresponding transverse bore of the wedge 25. The other end of the threaded spindle 33 extends to the outside and is connected with the output of a hydraulic motor 35. By way of lines, which are not shown in detail, this hydraulic motor 35 is connected with a control device. By way of its output, the hydraulic motor is also connected with an angle transmitter 36 by means of which the rotating position of the threaded spindle 33 can be detected. The position sensor 36 is also connected with the control device. As an alternative, the wedge 25 may be constructed as a manual operating device. For this purpose, it can be displaced manually in a direct manner. However, a manually operated threaded spindle may also be provided for its adjustment.

An adjustment of the wedge 25 is prevented by a special blocking device 51. This blocking device 51 comprises a ring piston 52 which interacts with a ring flange 53 provided on the threaded spindle 33. The ring flange 53 is supported on an interior shoulder 54 of a passage bore in the basic body 21 through which the threaded spindle 33 extends to form a direct non-positive connection with the threaded spindle. The threaded spindle 33 continues (without the thread) on the opposite side of the flange 53. This area is surrounded by the ring piston 52 which, adjacent to the flange 53, has a radially outward extending section 55 which, on its circumferential surface, is provided with a seal 52*a*. By means of a stepped bush 56, in which the ring piston 52 is disposed, this section 55 defines a working space A which can be acted upon by hydraulic fluid. On the side opposite the section 55 in the axial direction, the bush-shaped ring piston 52 is provided with another seal 57, so that the formed ring-shaped working space A is sealed off in both axial directions. When this working space is acted upon by hydraulic fluid, the ring piston 52 presses by means of its ring-shaped face against the flange 53 and presses the latter against the ring shoulder 54, whereby the threaded spindle 33 can be blocked in a targeted manner. The thrust bearing 31 is formed by the axially fixed bush 56 and the ring shoulder 54 in connection with the ring flange 53 which is disposed between the ring shoulder 54 and the bush 56. When the working space A is relieved from pressure, the threaded spindle 33 will be freely rotatable but axially non-displaceable.

Together with the threaded spindles 33 and the hydraulic motors, the wedges 25 each form an adjusting device with a separate driving device which is formed by the respective hydraulic motor 35. As a result, all bearing devices or adjusting devices and locking devices can be individually controlled.

The tool 15 fixed on the adjusting plate 20 is illustrated in FIG. 2. An outer tool part 41 is fixedly held on the adjusting plate 20. The outer tool part 41 is constructed in a bush-shaped manner and is used as a guide for an inner tool part 42 which can be adjusted by the wedge 25. This preferably takes place by an intermediate piece 43 which is guided by a carrying or covering plate 45 of the adjusting plate 20. The covering plate 45 is part of the multipiece basic body 21.

The adjusting plate 20 described so far operates as follows:

On its slide 4, the press 1 is first provided with the adjusting plate 20 in order to permit an adjustment of the tool which is individual for each tool stage. If the dies 15 to 18 are fastened to the individual bearing points 27, each die 15 to 18 can be moved to its desired adjusting position by a corresponding actuating of the hydraulic drives 35. When the press is set up, the hydraulic motors 35 are blocked (for example, by a corresponding hydraulic control) in order to maintain and not change the adjusted positions. This can be checked by means of the position sensors 36. However, an adjustment of the wedge 25 and thus an adjustment of the corresponding die 15 to 18 is possible at any time.

A tool change takes place by unscrewing the bolts 27. The adjusting plate 20 remains in the press 1. However, as required, it may also be exchanged or removed.

An adjusting plate 20 for a transfer press 1 has several individually adjustable tool mounting sites (bearing devices). An individually adjustable adjusting device 25 is assigned to each mounting site 15*a*, 16*a*, 17*a*, 18*a*. Sensor devices 36 provide acknowledgments concerning the set adjusting position. The adjusting devices 25 are also connected with individual blocking devices 51. The adjustment and the blocking takes place by means of corresponding hydraulic drives 35, 52 or can take place manually.

What is claimed is:

1. Adjusting plate for a transfer press for massive forming, comprising a basic body which is set up for the detachable fastening to a press slide or a press bedplate, a holding device which is set up for supporting a tool part and is arranged in or on the basic body, adjusting devices which are assigned to the holding device, a driving device is assigned to each adjusting device and includes a horizontally-disposed spindle gearing, and a blocking device operatively associated with the spindle gearing as a non-positive direct connection for preventing undesired activation of the adjusting devices.

2. Adjusting plate according to claim 1, wherein force transmitting elements are assigned to the holding device which, in a guide, is disposed to be adjustable in a working direction corresponding to the working direction of the slide.

3. Adjusting plate according to claim 1, wherein the adjusting device is a wedge-type gearing having a wedge which can be moved transversely to the working direction of the slide.

4. Adjusting plate according to claim 3, wherein the driving device which is connected with an adjusting drive for adjusting the wedge.

5. Adjusting plate according to claim 4, where in the adjusting drive is a hydraulic drive.

6. Adjusting plate according to claim 1, wherein a sensor arrangement for detecting the adjusting position is assigned to the adjusting device.

7. Adjusting plate according to claim 4, wherein the sensor device is a position sensor connected with the adjusting drive to detect its position.

8. Adjusting plate according to claim 1, wherein the driving devices are connected with a control device and the control device is constructed such that the driving devices can be actuated independently of one another.

9. Adjusting plate according to claim 1, wherein the blocking device is connected with the control device.

10. Adjusting plate according to claim 1, wherein the adjusting device is a manual operating device.

* * * * *